United States Patent [19]

Lehtinen et al.

[11] Patent Number: 4,584,058

[45] Date of Patent: Apr. 22, 1986

[54] METHOD AND APPARATUS FOR DEWATERING A FIBROUS WEB

[75] Inventors: Antti Lehtinen, Jyväskylä; Väinö Sailas, Vaajakoski; Markku Lampinen; Bjarne Ekberg, both of Turku, all of Finland

[73] Assignee: Valmet OY, Finland

[21] Appl. No.: 612,721

[22] Filed: May 21, 1984

[30] Foreign Application Priority Data

May 20, 1983 [FI] Finland ..... 831807

[51] Int. Cl.[4] ..... D21F 11/00

[52] U.S. Cl. ..... 162/199; 162/204; 162/205; 162/217; 162/275; 162/358; 162/367; 34/9; 34/16; 34/95; 34/92; 428/315.9; 428/316.6

[58] Field of Search ..... 162/199, 203, 205, 206, 162/208, 217, 274, 275, 273, 297, 308, 348, 358, 359, 360.1, 363, 367, 204, DIG. 1; 34/9, 95, 116, 123, 16, 92; 210/400, 401; 428/315.5, 315.7, 315.9, 316.6, 317.9

[56] References Cited

U.S. PATENT DOCUMENTS

| | | | |
|---|---|---|---|
| 3,421,230 | 1/1969 | Ward | 162/348 |
| 3,518,161 | 6/1970 | Ekberg et al. | 162/367 |
| 3,840,429 | 10/1974 | Busker et al. | 162/358 |
| 3,910,815 | 10/1975 | Shelor | 162/199 |
| 3,968,571 | 7/1976 | Oschatz et al. | 34/95 |
| 3,973,329 | 8/1976 | Feess | 34/9 |
| 4,162,190 | 7/1979 | Ashworth | 162/358 |
| 4,199,401 | 4/1980 | Liu et al. | 162/358 |
| 4,357,758 | 11/1982 | Lampinen | 34/9 |

*Primary Examiner*—S. Leon Bashore
*Assistant Examiner*—Andrew J. Anderson
*Attorney, Agent, or Firm*—Steinberg & Raskin

[57] ABSTRACT

An apparatus, method and band for forming and/or dewatering a fibrous web, in which the web or a pulp suspension layer forming the same is conveyed and supported through a significant portion of its run in a paper machine by a specific processing band, while liquid such as water is simultaneously removed therefrom by hydraulically contacting the same with liquid present under vacuum or underpressure within the processing band, through a finely porous, liquid-suction surface on the band that is saturated with liquid.

14 Claims, 5 Drawing Figures

METHOD AND APPARATUS FOR DEWATERING A FIBROUS WEB

BACKGROUND OF THE INVENTION

The present invention is directed to a method for forming and/or dewatering a web such as a fibrous web in a paper or cardboard machine, in which web formation is accomplished with a forming fabric and/or a particular band serving as a machine element for transporting the web forwardly and supporting the same. The present invention is also directed to an apparatus for forming and/or dewatering the web, e.g. a felted web, within a paper or cardboard machine, which comprises a band-like member guided by rotatably supported rolls, and serving as a machine element for both supporting the web itself and transporting the same forwardly. The present invention is also particularly directed to a processing band that is utilized for forming and/or dewatering such a fibrous web.

Conventionally, a porous paper web running through a paper machine is dried initially by dewatering on a fabric, such as a wire, or between two fabrics. Such initial dewatering reduces the moisture content of the paper web to a value $u_\nu=5.7$ to 2.3 (g of $H_2O$ per g of dry matter), depending upon the brand of paper. Subsequently, further removal of water from the web is accomplished in the press section of the paper machine by passing the web in the nips of press rolls in which a porous felt is generally also applied to enhance the dewatering. The moisture content of the paper web is generally reduced in the press section of the paper machine to a value $u_\nu=1.6$ to 1.2. Following the press section, the paper web is dried through evaporation, e.g., utilizing multiple cylinder dryers, where the web to be dried is placed in contact with steamheated, smooth-surfaced drying cylinders. The ultimate moisture content of the paper web is generally in the range $u_\nu=0.05$ to 0.1.

As conventionally known, the web is dewatered by suctioning with the aid of stationary upper and lower suction boxes or rotary suction rolls. Suctioning effect is also produced with so-called foil lists. Furthermore, both gravitational and centrifugal forces are utilized in the dewatering process.

In the press section of a paper machine, water is expressed from the web in a conventional manner, within a nip defined by two rotating rolls, or within a nip defined by a roll and a shoe urged against it. The fibrous web, e.g. a paper or cardboard web, is then interposed either between a fabric (a so-called "felt") and a press roll which is often formed from granite, or the fibrous web is disposed between two such felts. The press nip itself may also be defined by a granite roll and a cooperating roll with a smooth or recessed surface, this latter cooperating roll also being a so-called suction roll. Conventionally, a sandwich-type structure supporting the web passes through the nip, such structure comprising various bands, coatings, felts, along with the running fibrous web while the nip itself may be constituted by a plurality of rolls rotating on both sides of the sandwich-type structure passing therethrough, or only one roll disposed to rotate on only one side of the sandwich-type structure thereof (e.g. when a shoe forms the other press component on the opposite side of the sandwich-type structure). Thus, such a press nip may be provided and disposed in a variety of ways, as conventionally known. As noted above, one of the rolls defining the press nip may be conventionally replaced with a stationary press shoe, in which case a deformable band is disposed between the shoe and the felt run, while lubricant is also introduced between the shoe and the band itself.

Although pressing at elevated temperatures within the nip has been carried out in the dewatering/pressing operation in order to alter the viscosity of the water and the elastic characteristics of the fibrous web itself, thereby attaining a higher dry matter content of the running web, it is not possible with conventional pressing procedures to attain the ultimately-desired dry matter content of the running web for intended use. The remainder of the water contained within the web has to be removed therefrom by evaporation along the surface of rotating drying cylinders. In this drying step, various drying wires and fabrics have been utilized, as well as particular air streams designed to remove escaping water vapor. It is well known that drying cylinders may be heated in a number of different ways, the most common of which is to conduct hot steam directly into the cylinders. The cylinders and fabric also serve as a mechanism for transporting the running web itself. The web may also be dried, transported, and supported by means of an air cushion.

In addition to drying of the web, correction of the dry matter profile is also carried out. In other words, water may be added to the running web in a controlled manner, so that a desired dry matter profile is obtained across the web. Thus as conventionally done, the moisture content and profile of the running web are controlled so that quality requirements imposed on the final product, e.g. paper, will be attained as best as possible. However, drying of a paper web by evaporation is not energy efficient. Drying by evaporation consumes remarkable quantities of energy, since the energy required for evaporation of water is about 2,500 kJ/kg.

In conventionally-known paper manufacturing techniques, water drains, for example, into save-alls disposed along the machine, into suction boxes, into holes of suction rolls, or into cavities along a recessed-surface of such rolls, and into the felts themselves, at the very same location where the water is removed from the web. An alternative to this type of water removal is to utilize a felt which receives and conveys water while exiting from the press nip. However, this type of operation is clearly disadvantageous, since water remaining in the felt may re-wet the web if the web and felt are in contact with one another after exiting from the press nip. However, other technical solutions have not been conceived.

U.S. Pat. No. 4,357,758, issued Nov. 9, 1982, discloses a procedure for drying a porous web-like object such as paper, or a granular material such as peat, or a solid material, such as wood. In the particular procedure disclosed therein, the object to be dried is placed in contiguity with a fine-porous suction surface saturated with a liquid and which is in liquid communication with a volume of liquid which is maintained at an underpressure or reduced pressure relative to the pressure of the liquid in the object to be dried. In this patent, an apparatus for carrying out this method is disclosed, which comprises a finely-porous, liquid suction surface with radii of pores therein within the range of about 0.05 to 2 microns. The suction surface is saturated with liquid by placing the same in communication with liquid confined in a liquid volume defining means which itself communicates with means for creating an underpressure or vacuum.

Additionally, drying means for a fibrous web is disclosed in the above-mentioned patent, which comprises at least one water-suction cylinder, in conjunction with which a permeable fabric or band is disposed so that the web is urged against the finely-porous, water-suction surface. This particular type of apparatus offers great potential possibilities for water-suction drying, in principle. However, there is a practical problem encountered in that it has been difficult at contemporary high paper machine speeds (e.g. about 17 m/s) to realize sufficiently long delay times of the running web in conjunction with the finely-porous, water-suction surface of the cylinder which a water-suction drying process requires, without having to use cylinder diameters which are undesirable from the viewpoint of practical embodiments, or extremely numerous cylinders. Additionally, in this particular type of apparatus, it has been necessary to utilize disadvantageous structural designs regarding pump means with which the liquid space communicating with the water-suction surface is placed under the underpressure or vacuum for water-suction drying.

SUMMARY OF THE INVENTION

Accordingly, it is an object of the present invention to provide a new and improved method and apparatus for forming and/or dewatering a fibrous web which avoid drawbacks in previously-used dewatering and/or forming operations of such running fibrous webs.

It is also an object of the present invention to provide a particular band that can be utilized to more efficiently and more practically dewater and/or form a fibrous web.

It is a further object of the present invention to improve water-suction drying of a running web during a forming and/or dewatering operation.

It is still another object of the present invention to provide for improved control of overall dry matter content within a fibrous web.

It is a still further object of the present invention to improve forming and/or dewatering of a running fibrous web, so that subsequent dewatering by evaporation can be minimized.

It is another object of the present invention to improve conveyance of a running fibrous web being dewatered and/or formed through a paper machine, so that frequency of web breakage and consequential shutdown time are significantly reduced.

It is still a further object of the present invention to improve utilization of drying felts and equivalent fabrics in a dewatering amd/or forming operation of a running web, such utilization of felts or fabrics being a contemporary trend in paper machines.

Briefly, in accordance with the present invention, these and other objects are attained by providing a method wherein a running fibrous web, such as paper web or cardboard web, is supported and conveyed along a substantial portion of its run, e.g. through a substantial portion of a paper machine, on a run of a closed loop of a particular processing band. Simultaneously, a substantial amount of liquid is removed from the web itself or a pulp suspension layer being formed into the web, by hydraulically contacting the same with liquid present under vacuum within the band, by way of a finely porous, liquid-suction surface of the band that is saturated with liquid.

The present invention also provides an apparatus for forming and/or dewatering a fibrous or felted web such as a paper or cardboard web, the apparatus comprising a band-like member that is provided with at least one microporous, liquid-suction surface, means for placing the interior of the band under a pressure which is lower than the pressure which is acting on the outer surface of the web or pulp suspension layer, means for placing the web or pulp suspension layer in contact with the outer, microporous, liquid-suction surface of the band, and means for detaching the web or pulp suspension layer from the band and conducting the web or pulp suspension layer forming the web away therefrom, e.g. to a drying section in a paper machine.

The present invention also provides a processing band utilized in the dewatering and/or forming of a fibrous web, which comprises a resilient core that is elastically and reversibly compressible in the direction of thickness of the band, a space within the resilient core, e.g., interstices therein, to receive liquid such as water released from the web or pulp suspension layer, and at least one outer surface constituted by a microporous, liquid-suction film layer. The Radii micropores within this outer layer range from about 0.05 to 2 microns. Such a film or outer layer always has a liquid-retention capacity involved in liquid-suction drying.

At least two of the following principle functions are accomplished by the method, apparatus, and particular processing band of the present invention, namely formation of a fibrous web such as a paper web, drying of such a web, and the conveyance thereof. These functions are accomplished by the present invention either alone, or in combination with other known features.

In the method of the present invention, liquid, e.g. water, removed from the running web during dewatering, may pass along with the so-called processing band, described in more detail below, even over a large distance before being removed from the band into a discharge liquid system of the machine. Detrimental rewetting will not occur, because liquid such as water moves on the liquid suction film or surface of the processing band in one direction only, i.e. away from the fibrous web.

Within the scope of the present invention, the concept of a liquid-suction surface or film is understood to mean that air (or gas in general) cannot pass through such a liquid-suction surface or film at the differential pressures between air/gas and liquid employed in the drying operation. The term "suction surface saturated with liquid" as used herein shall be understood as meaninq that the ambient atmosphere, generally air, cannot permeate the suction surface with the differential pressures applied according to the present invention between the air and the liquid. This provision constitutes an essential difference between the present invention and conventional drying procedures known in the prior art. More particularly, in conventional suction drying arrangements, e.g., suction rolls in a paper machine, air will pass through the suction surface (the surface of the suction roll) in addition to the liquid being dewatered from the web. Of course, in such conventional procedures, air also passes through the object that is being dried so that the drying thereof is in fact based upon the friction which exists between the liquid and the air. In order to maximize the friction as measured by the differential pressure of air across the object to be dried, the air flowing through the suction surface must be maximized. Of course, however, this results in high energy costs. Furthermore, even with maximized efficiency of operation of other conventional arrangements, the drying obtained is not as good as desired. For example, in paper machines, moisture content $u_\nu$ of only about 2.3 have been obtained.

The apparatus and method of the present invention entirely alter the nature of the paper web-making operation, because conduction of the running web or pulp suspension layer itself takes place principally with the web supported by the processing band, while liquid (e.g. water) is simultaneously withdrawn from the web while it is being transported. Thus the present invention affords enough time for dewatering of a running paper web to occur.

Additionally, use of high gauge and vacuum pressures can be substantially reduced with the present invention, thus reducing the overall paper manufacturing costs. Another advantage of the present invention is that less power is required for transporting a web as compared with the power requirements of a shoe or of a large line-pressure nip. Another important advantage gained with the present invention is that a fibrous web such as a paper web is conveyed with support especially in the phase of manufacture where mechanical strength is low, thereby reducing any risk of web breakage and as a result incurring much less shut-down time in the overall paper making operation.

In the present invention, removal of liquid from, the fibrous web itself, is based on the overall liquid-suction principle disclosed in U.S. Pat. No. 4,357,758. As noted concerning the liquid suction principles disclosed in this patent, if pores in a porous film, e.g. the capillaries therein, are filled with liquid such as water, the surface force between the liquid therein and the film or surface prevent the capillaries from being voided of liquid or water, even if a vacuum is created along one side of the film or surface. The magnitude of this liquid-retention capacity, i.e. the degree of vacuum required to remove water or liquid from the film, can be calculated by the formula:

$$\Delta p = \frac{2\,\gamma \cos\theta}{R}$$

where $\gamma$ designates the surface tension of the liquid such as water, $\theta$ is the contact angle between the free surface of the water and the surface of the liquid-suction film, and R is the radius of the largest pore or capillary within the water-suction film or surface. Using the above formula, if the radius R is 1.2 microns and the contact angle is 30°, then the maximum under pressure for water at 20° C. is 1 bar ($\gamma$ equals $70\times10^{-3}$N/M). When a wet paper web or like porous object to be dried is placed upon the liquid-suction surface or film, the liquid or water within the web and in the capillaries of the surface or film form a coherent liquid film. Since the pressure of liquid both in and below the surface on the band is reduced, water begins to flow out from the web by being pulled or "milked" with the aid of water molecules disposed within the liquid-suction surface.

Such liquid or water flow will continue until the running web has become so dry that the liquid or water pressure therein is the same as the pressure of liquid or water under the liquid-suction film or surface. This means that by reducing the cross-sectional area of the individual capillaries or pores in the liquid-suction film and by using a greater vacuum, the running web can be dried to a great extent by the present invention. A practical limit is imposed on the overall drying of such a web that can be obtained, on the one hand by the maximum density with which the liquid-suction film can be prepared, and on the other hand by the available vacuum. Continuous increase of the vacuum within the processing band is not feasible because liquid or water contained within the running fibrous web will begin to boil at a certain decrease of pressure, e.g. 0.023 bar at 20° C. However, it is theoretically possible to obtain a value $u_\nu$ of 0.3 with a pressure $\Delta p$ of 0.9 bar. This amounts to 77% as expressed as a dry matter percentage of the running paper web, appreciably higher than what is presently being attained at the greatest possible efficiency in conventionally-known press sections ($u_\nu$=-about 1.17).

Liquid-suction films or layers such as described above and having a suitable porosity for the liquid-suction drying requirements, are commercially available.

The present invention also eliminates the difficulties associated with the time consumed by overall drying of a running web. Since the velocity of a running web in a contemporary paper machine is rapid, e.g. than 20 m/s, a running web should be in contact with a liquid-suction surface for a substantially longer period of time than the time which the running web is disposed within a roll nip of a press, or upon a suction box, in order to have sufficient time for requisite drying to take place. At best, the time allotted for drying may be as little as a few seconds. However, even in that short of period of time, the web still moves several tens of meters, as noted above.

With the method and apparatus of the present invention, this difficulty has been eliminated in that the paper web is guided onto a process band forming an endless, closed loop and having a length such that the required drying time is achieved. An appropriate liquid-suction film or layer is disposed along a surface of the processing band, preferably along the top surface thereof, while an underpressure or vacuum is established between the upper and lower surfaces of the processing band itself. In this manner, proper conditions for taking advantage of the liquid-suction technique described above, have been created. A needled felt or equivalent that is traditionally used in a paper-making machine for supporting a running web and transporting the same through a press nip, cannot be used in this operation. A particular band having a special structure in accordance with the present invention must be used instead. Such a band is termed a "process or processing band" within the context of the present invention. This term means that such a band removes liquid such as water from a running fibrous web over an extended period of time, while at the same time moving the running web itself, with such liquid or water being removed from the processing band at a suitable location.

The process or processing band of the present invention may be provided with several features. At least one of the following embodiments is feasible within the context of the present invention. A processing band may be formed with a porous and deformable supporting layer constituting the major portion of the band itself, manufactured, e.g., of a resiliently deformable elastomer that is capable of absorbing as much liquid or water as possible within its pores or capillaries. The coating upon this interior body or core layer, such coating lying directly against a running fibrous web, is a microporous film that is appropriate for liquid-suction drying, with a surface of the processing band on the opposite side thereof being formed of a rubber or plastic film that is impermeable to liquid or water. Alternatively, the opposite side of the processing band from the liquid-suction film, may also be formed as another microporous, liquid-suction surface.

Water or liquid removal from the processing band may be accomplished, for example, by conveying the processing band itself, into a nip defined by a pair of rolls, where liquid or water therein is removed or squeezed out by pressing. The interior core or body of the processing band must be elastic so that after such pressing, the processing band will expand to its original thickness. However, since the liquid-suction surface or film is not permeable to air, a vacuum builds up within the processing band as it regains its original thickness after such pressing. Thus, creation and maintenance of a vacuum within such a band is based upon the resilience of the band and on the impermeability to air of the liquid-suction layer on at least one surface thereof.

A particularly advantageous procedure for removing liquid or water from the processing band, is to tighten the same to a suitable tension, e.g. on a given sector of a return roll. In this situation, a tension of suitable magnitude is required, e.g. on the order of about 20–50 kN/m. For dewatering or removimg liquid from the processing band itself, a combination of tightening of the band and passing the same through at least one such press nip, may be utilized. Such dewatering accomplished by tightening of the processing band is also advantageous, in that cleaning of the liquidsuction film layer will then occur within the same capillaries or pores of the liquid-suction surface layer by reverse action from the liquid-suction thereinto. A processing band of the present invention may be prepared with microporous, liquid-suction layers or films disposed on both sides thereof, each such film having a fairly small thickness, for example less than about 1 mm.

BRIEF DESCRIPTION OF THE DRAWINGS

A more complete appreciation of the present invention and many of the attendant advantages thereof will be readily appreciated by reference to the following detailed description when considered in conjunction with the accompanying drawings, in which.

DETAILED DESCRIPTION OF THE PREFERRED EMBODIMENTS

Figure 1:
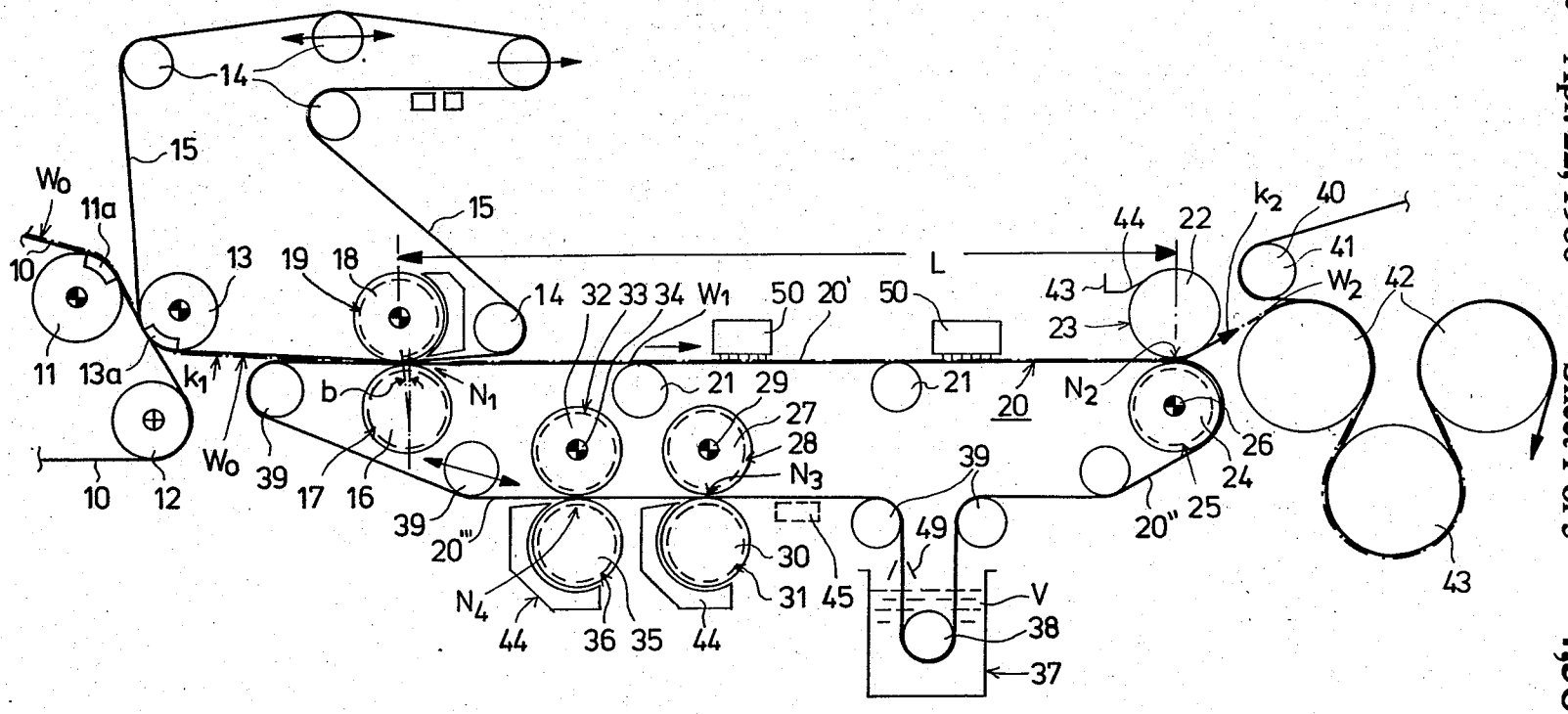
FIG. 1 is a schematic elevational view of a press section of a paper machine, utilizing the method, apparatus, and processing band of the present invention for liquid-suction drying.

Referring to the drawings, notably FIG. 1, a paper web $W_0$ is formed in a known forming section on a forming wire 10. Paper web $W_0$ moves with forming wire 10 across a suction zone 11*a* of a suction roll 11, and then onto a pick-up fabric 15 with the aid of a suction zone 13*a* of a pick-up roll 13. The forming wire 10, from which the paper web $W_0$ has been detached, continues to pass over a traction roll 12. The web $W_0$ moves on the underside of the pick-up felt 15 guided by rolls 14, to a transfer nip $N_1$, where the web $W_0$ is transferred onto a particular processing band 20 according to the present invention.

Dry matter content of the web $W_0$ arriving from the forming section onto processing band 20, is denoted by $k_1$. This dry matter content is as a rule on the order of about 15 to 20%. Water-suction drying of the run of the web $W_1$ takes place over a substantially horizontal upper run 20' of the processing band 20, the length of which is denoted by L, in accordance with the present invention, utilizing the particular processing band 20 of the present invention. Transfer nip $N_1$ is defined by an upper roll 18 having a recessed surface 19, and by an equivalent lower roll 16 also having a recessed surface 17. This lower roll 16 is positioned within the closed loop of the processing band 20 as illustrated in FIG. 1.

Paper web $W_0$ is made to adhere to the processing band 20 in the lightly-loaded transfer nip $N_1$ with the aid of a felt cover, over the angle b indicated in FIG. 1. Due to the surface properties of the processing band 20, the web $W_0$ will more readily adhere thereto than to the pick-up felt 15 which has a rougher surface.

The horizontal run 20' of the processing band 20 is supported by rolls 21. This run 20' terminates at a transfer nip $N_2$ that is defined between a smooth-surfaced upper roll 23 and a lower roll 24 which is provided with drive means 26 and has a recessed surface 25. The run of the web $W_2$, having reached a dry matter content $k_2$, adheres to the smooth surface 23 of the upper roll 22 which is, for example, a stone roll, with the run of the web $W_2$ then entering a drying section. Because of the water-suction drying of the paper web run that takes place on the processing band 20 in accordance with the present invention, dry matter content $k_2$ of the web may be as much as 70%. Due to this advantageous drying, in the subsequent drying section illustrated in FIG. 1 which includes upper cylinders 42, a lower cylinder 43 and a drying felt being guided by a roll 41, only a fraction of the number of drying cylinders previously needed in drying sections of the prior art is required, with such prior art press sections attaining a dry matter content $k_2$ of the web only on the order of about 38% to 43%.

After separation from the running web at nip $N_2$, the processing band 20, having a run 20'' guided by the roll 24 and by guide rolls 39, and filled with liquid such as water, continues to a washing station 37 where the processing band 20 passes over a roll 38. Liquid-removing doctors 49 and an ultrasonic cleaner 45 are disposed after the washing station 37 in the running direction of the band.

The processing band 20, now cleaned along its surface, is still filled with liquid such as water. In the subsequent nips $N_3$ and $N_4$, the processing band is squeezed to a smaller thickness to expel water therefrom whereupon the band comes absorptive. Press nip $N_3$ is defined between an upper roll 27 provided with drive means 29 and recessed surface 28, and a lower roll 30 also having a recessed surface 31. Similarly, the following nip $N_4$ is also defined between an upper roll 32 provided with drive means 34 and recessed surface 33, and a lower roll 35 also provided with recessed surface 36. Save-alls 44 are provided in conjunction with both lower rolls 30 and 35.

After nips $N_3$ and $N_4$, the run 20''' of the processing band 20 is now in an absorptive condition. As noted previously, micropores of liquid or water within the suction surface of the processing band 20 are not emptied and filled with gas such as air. The processing band 20 passes in this state over guide rolls 39 to the first nip $N_1$, where it contacts and supports the incoming liquid-containing web $W_0$ to be dried, as noted above.

Figure 3:
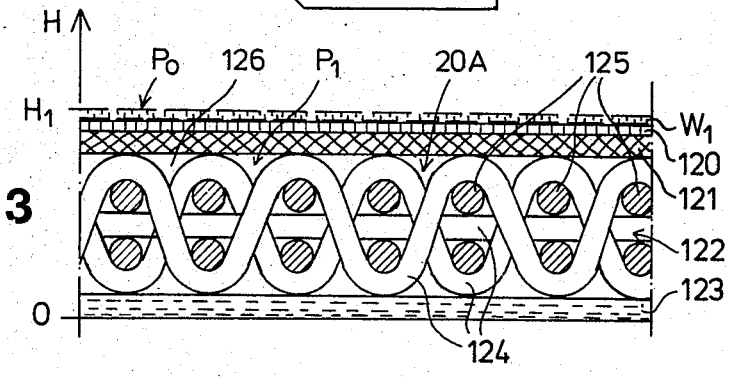
FIG. 3 is a sectional view of one embodiment of a processing band of the present invention, on a scale slightly larger than actual size.

One embodiment of the processing band 20 of the present invention is depicted in cross-section in FIG. 3. The processing band 20A illustrated in this figure is both compressible and expandible in the direction H of its thickness. This processing band 20A includes a lower layer 123 impermeable to liquid such as water, e.g. constituted of rubber or plastic. This layer 123 constitutes an inner surface of a loop of a processing band 20 such as illustrated in FIG. 1. A reticular layer is disposed inwardly from this lower, water-impermeable layer 123, the reticular layer constituting the resilient or elastic interior of the processing band 20A. Spring layer 122 forming a part of this reticular layer, is composed of wefts 124 and warps 125. A water or liquid-permeable, porous supporting layer 121 is disposed upon spring layer 122, with a water or liquid-suction film 120 being attached to the outer surface of supporting layer 121 as illustrated in FIG. 3. Nylon 66 film (Polyamide, Pall, Great Britain) may be used as the liquid-suction film 120. The liquid-suction film or surface 120 is quite thin, for example only about 0.1 mm thick, and has a rather high porosity, about 80%. Therefore, the flow resistance of this exemplary film or surface is quite low. As illustrated in FIG. 3, the run of the paper web $W_1$ is disposed upon this surface or film 120, with the web $W_1$ being dewatered along the interval L indicated in FIG. 1, with the aid of the vacuum or differential underpressure created within the interior of the processing band 20A. In other words, since the pressure $P_1$ within the interior of the processing band 20A is much less than the pressure $P_0$ acting on the outer surface of the run of web $W_1$ as illustrated in FIG. 3, a differential pressure $P_0$–$P_1$ is created, which serves to attach the web $W_1$ against the surface 120 of processing band 20A as illustrated, while also dewatering the same by the technique described above.

Figure 4:
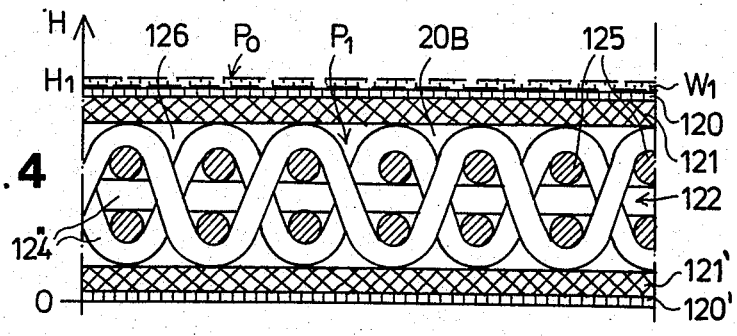
FIG. 4 is a sectional view similar to FIG. 3 of another embodiment of a processing band of the present invention having two liquid-suction films or layers on opposite sides thereof.

Another embodiment of a processing band 20B according to the present invention is illustrated in FIG. 4 in a similar manner to FIG. 3. The processing band 20B illustrated in FIG. 4 has a structure similar to the processing band 20A illustrated in FIG. 3, except that in the processing band 20B illustrated in FIG. 4, the layer 123 that is impermeable to water has been replaced with another water-permeable layer 121', on the outside of which another microporous liquid-suction film 120' has been attached. Processing band 20B illustrated in FIG. 4 may be especially used in applications where a suction box filled with liquid and maintaining a vacuum therein is disposed against the inner surface 120' of the running loop of the processing band 20B. Dewatering of the web, or of an equivalent pulp suspension layer, will then take place through both liquid-suction films 120 and 120'. In an embodiment of the present invention of this type, nips $N_3$ and $N_4$ by which processing band 20B is made absorptive, are not absolutely necessary, and there is no absolute requirement for a spring-like layer 122 within the interior of the processing band 20B in this particular embodiment.

Figure 5:
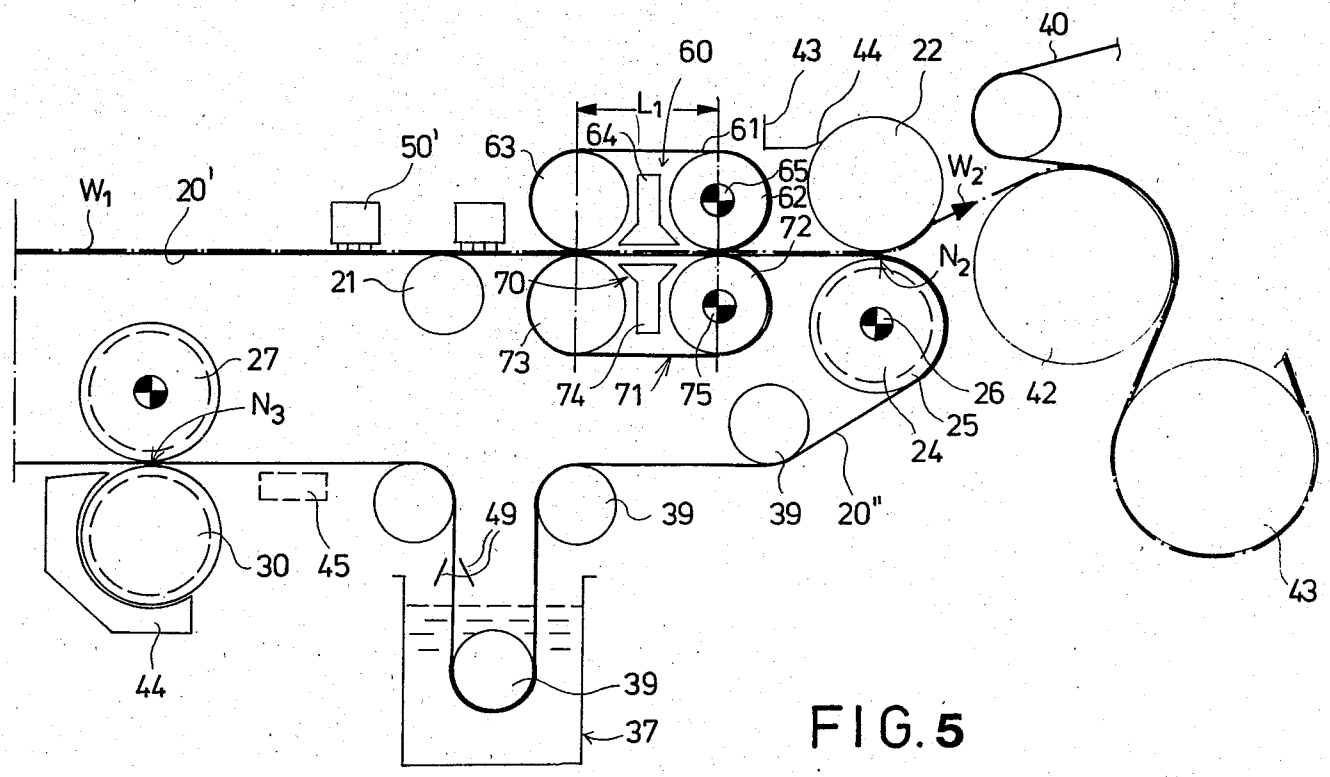
FIG. 5 is a schematic illustration similar to FIG. 1 of another press section of a paper machine utilizing another embodiment of the method and apparatus of the present invention.

FIG. 5 illustrates a modification at the end of the joint run of the web $W_1$ and the process band 20' of FIG. 1. corresponding components have been indicated with the same reference numerals in FIG. 5 as used in FIG. 1. As illustrated in FIGS. 1 and 5, infrared radiators or steam boxes 50, 50' have been disposed along the joint run of the web $W_1$ and supporting processing band 20', adjacent the outer, exposed surface of the web $W_1$. In FIG. 5 in particular, these infrared radiators or steam boxes 50' have been disposed towards the end of the joint run of the web $W_1$ and supporting processing band 20'. Disposition of these infrared radiators or steam boxes enhances the dewatering of the web $W_1$, as explained further below.

Just before the end of the substantially horizontal run L of the processing band 20' and the web $W_1$ thereon, and prior to the transfer nip $N_2$, a type of long-nip press has been arranged for creating a liquid-saturated condition in the final phase of the liquid-suction, dewatering process. This long-nip press comprises two band means 60 and 70 operating against one another on opposite sides of the joint run of web $W_1$ and process band 20', these two band means 60 and 70 pressing the processing band 20' and the web $W_1$ together from opposite directions along the run $L_1$ as illustrated. The long nip press also comprises opposing traction rolls 62, 72 which are each provided with respective drive means 65, 75 and respective return rolls 63, 73. Band loops 61, 71 are wrapped around the respective traction rolls and return rolls as illustrated. Glide shoes 64, 74 are disposed within the respective band loops 61, 71, for pressing the processing band 20' and web $W_1$ together, as the web supporting processing band 20' passes between the bands 61 and 71 as illustrated. In other regards, the structural and operational aspects illustrated in FIG. 5 are similar to those described above in conjunction with FIG. 1.

The radii R of the micropores in the water-suction films or layers 120, 120', are advantageously in the range of about 0.05 to 2 microns. The thickness of the processing band 20 in an uncompressed condition $H_0$ (FIG. 2) is usually in the range of about 1 to 10 cm. As a rule, the thickness of the liquid-suction films 120 and/or 120' is less than about 1 mm.

Figure 2:
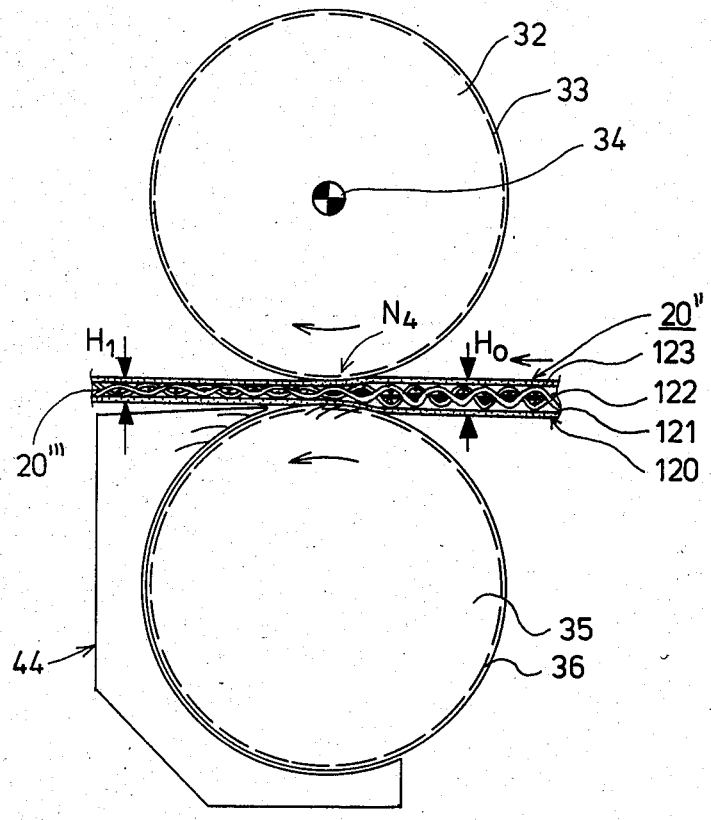
FIG. 2 is a side, elevational view, partially in section, of a roll press in which water is expressed from the processing band of the present invention while at the same time producing a vacuum or underpressure therewithin.

As viewed in FIG. 2, when the run of the processing band 20'' is forced through the nip $N_4$ to change from thickness $H_0$ to compressed thickness $H_1$, the reticular, elastic portion 122, 124, 125 of the processing band 20 is simultaneously compressed into a stressed condition, whereby liquid or water escapes from the interior of the processing band through the layers 121 and 120, with the outer liquid-suction layer 120 remaining saturated with liquid or water. In this manner, the run of processing band 20''' is returned to an absorptive state. Due to the particular microporous structure and disposition of the liquid-suction film 20 as noted above, a vacuum within the interior of the processing band 20 is maintained, until the web $W_0$ saturated with liquid such as water comes into contact with the top surface 120 of the processing band, where the release of water from the web $W_1$ will commence, in accordance with the present invention.

When the processing band 20 is compressed within the nips $N_3$ and $N_4$, the processing band 20 may be stretched. This can be controlled with the speed differential of the driven upper rolls 27 and 32. Similarly, as the processing band 20 absorbs water from the web $W_1$ along the length L of the joint run thereof between the nips $N_1$ and $N_2$, the processing band 20 may simultaneously shrink in the direction of travel of the web $W_1$, as the processing band 20 itself swells. This can also be controlled with the speed differential of the driven rolls 24 and 18.

Both edges of the processing band are sealed so that the vacuum or underpressure produced inside of the processing band 20 for dewatering will not escape through the sides thereof. If necessary, the processing band 20 may be divided by transverse partitions into various compartments so that after passing through nips $N_3$ and $N_4$, the vacuum pressure or underpressure will not be equalized in the longitudinal direction of the processing band 20 and in the direction of travel of the web W. Other spring-type or resilient components may be used instead of the reticular elastic fabric 122, 124, 125, such for example as components resembling a spring mattress.

An advantageous technique of removing water from the processing band 20 that has passed thereinto from the web $W_1$, is to tension the processing band 20 in the direction of travel. This technique of dewatering the processing band may be used either alone, or in conjunction with the overall dewatering of the processing band 20 taking place by pressing within the nips $N_3$ and $N_4$, as described above. The following numerical example illustrates dewatering that is accomplished by tensioning of the processing band 20.

If the tension within the processing band 20 is for example 37 kN/m (if the calculated value of wire tension within a paper machine is 8 kN/m, then 37 kN/m is not a tremendous requirement), the diameter of the return roll is 500 mm, and the contact angle of the band upon this roll is 30°, a pressure of 0.7 bar is produced within the band. The base weight of paper to be dried is assumed to be 48 g/m$^2$. In the liquid-suctioning procedure, the paper is dried from a 25% dry matter content to a 50% dry matter content. The thickness of the water film is then 0.1 mm, with passage through the film at a velocity of 4 mm/second taking 0.025 second. This means that at a machine speed of 20 m/sec, the web can travel 500 mm during this period of time. This is the same distance through which the band is in contact with the return roll, assuming a 30° contact angle and a 500 mm roll radius.

This calculation reveals that mere tensioning of the band 20 is sufficient to dispose it under overpressure if the band can be pulled, e.g., with a force of 37 kN/m. At the same time, the capillaries of the band 20 are cleaned in an ideal fashion, because the water now flows in a reverse direction in the capillaries. Of course, greater pressure may be employed in the nip voiding, whereby the flow velocity increases while the flow-out time of the water is shortened. It is possible, of course, to use a combination of tensioning and press nips for overpressuring and cleaning of the band 20.

In the method and apparatus of the present invention, it is usually preferred to use a process band 20A (FIG. 3) having a water-suction film 120 disposed on the outside of the loop. When a two-sided processing band 20B is used as illustrated in FIG. 4, only one of the water-suction film layers, namely layer 120, actively communicates with the run of the web $W_1$, while the other water-suction film layer, namely layer 120', acts to pass water in one direction only (i.e. outwardly from the band 20 when the same is dewatered). One way of utilizing a twosided processing band 20B illustrated in FIG. 4 in accordance with the present invention, is by turning the processing band loop inside out after one layer of water-suctioning film 120 operating against the web $W_1$ becomes worn out or blocked, with the opposite layer 120' being subsequently used to actively operate against the web $W_1$.

As described in U.S. Pat. No. 4,357,758, an extraordinary way of enhancing the overall dewatering operation is to utilize infrared radiation. Thus, as illustrated in FIG. 1, infrared radiators 50 may be disposed along the run L of the web $W_1$, in order to intensify the dewatering thereof (or equivalent mechanical, high frequency vibrating means may be used).

As noted above, the present invention may be applied in a section corresponding to the press section of a paper machine and/or in a forming section thereof. An application is possible in which the web or a pulp suspension layer is interposed or sandwiched between two such processing bands, in which case dewatering of the web $W_1$ takes place through both surfaces of the web, having the advantage that the web itself becomes more symmetrically dewatered than before, because of improved fines and filler distribution therein.

In most cases, the delay times of the web and/or pulp suspension layer on the processing band or bands of the invention in the entire paper machine, are in the range of about 0.5 to 5 seconds. Accordingly, the length of the active portion L of the processing band 20 is in general in the range between about 5 to 50 m.

Numerous modifications and variations of the present invention are clearly possible in the light of the above teachings. It is therefore to be understood that within the scope of the claims appended hereto, the invention may be practiced otherwise than as specifically disclosed herein.

What is claimed is:

1. A method for dewatering a web in a paper machine, comprising the steps of:

providing a looped processing band adapted to support and carry the web along a substantial portion of its run, the processing band including an outer liquid-saturated, fine porous suction surface which impermeable to air and a water-containing porous layer in liquid communication with the suction surface;

maintaining the water in the water-containing porous layer within the processing band at an underpressure relative to the pressure of the water in the web;

transferring the web onto the processing band to contact the liquid-saturated air impermeable fine porous suction surface thereof;

carrying the web in contact with the suction surface of the processing band along a substantial portion of its run while the water in the porous layer of the band is being maintained at an underpressure, the water present in the web being thereby brought into hydraulic contact with the water in the porous layer of the processing band through the liquid-saturated air impermeable fine porous suction surface so that water contained in the web passes through the suction surface into the porous layer to thereby dewater the web; and after transferring and dewatering the web, separating the same from the processing band and them removing water from within the processing band at least partly by tensioning the band in its direction of travel so that suitable over-pressure is created within the same to expel water through at least one surface thereof to regenerate the band into an absorptive condition and then conducting the band into contact with the web so that dewatering of the web begins.

2. The method of claim 1, wherein the tensioning of the band also cleans capillaries therewithin, in at least one surface thereof.

3. A method for dewatering a web in a paper machine, comprising the steps of:

providing a lopped processing band adapted to support and carry the web along a substantial portion of its run, the processing band including an outer liquid-saturated, fine porous suction surface which is impermeable to air and a water-containing porous layer in liquid communication with the suction surface;

maintainig the water in the water-containing porous layer within the processing band at an underpressure relative to the pressure of the water in the web;

transferring the web onto the processing band to contact the liquid-saturated air impermeable fine porous suction surface thereof;

carrying the web in contact with the suction surface of the processing band along a substantial portion of its run while the water in the porous layer of the band is being maintained at an underpressure, the water present in the web being thereby brought into hydraulic contact with the water in the porous layer of the processing band through the liquid-saturated air impermeable fine porous suction surface so that water contained in the web passes through the suction surface into porous layer to thereby dewater the web;

after dewatering the web, separating the same from the band and directing the band into a compression zone defined by at least on nip, wherein some water is pressed out from the inner porous layer through the air impermeable liquid-saturated fine porous suction surface to regenerate the band into an absorptive condition and placing the remaining water in the inner water-containing porous layer under an underpressure, and conducting the band in this state into contact with the web so that dewatering of the web begins.

4. The method of claim 3 wherein the step of transferring the web onto processing band includes conducting the web and the band in the absorptive state while retaining an underpressure on the water in the inner porous layer into contact with one another in a transfer nip.

5. The method of claim 4 including the further step of:

cleaning at least the suction surface of the band after separating the same from the web and prior to removing water therefrom.

6. The method of claim 5 wherein the web is dewatered by carrying the same in contact with the suction surface of the processing band along a substantially horizontal run of the processing band of sufficient length to allow for timed, controlled removal of water from the web, said step of separating the web from the band includes conducting both through a transfer nip with the web adhering to a smooth roll thereof, and conducting the separated web to a drying section of the paper machine.

7. The method of claim 6 including the further steps of:

supporting the substantially horizontal run of the band with at least one roll, and disposing a stone roll and driven roll with a recessed surface to form the transfer nip separating the web from the band.

8. The method of claim 7 including the further step of:

directing at least one of infra-red radiation and equivalent vibration upon the web to loosen liquid-fiber bonds therein.

9. The method of claim 8 including the further step of:

disposing the band with two opposite outer surfaces thereof formed as fine porous, air impermeable, liquid-suction surfaces.

10. Apparatus for dewatering a web in a paper machine, comprising:

a looped processing band mounted on support rolls to support and carry the web a substantial portion of a run thereof, said processing band including an outer liquid-saturated fine porous suction surface which is impermeable to air, a water-containing porous layer in liquid communication with said suction surface, and means for maintaining the water in the water-containing porous layer within the processing band at an underpressure relative to the pressure of the water in the web;

means for transferring the web onto the processing band to contact the liquid-saturated air impermeable fine porous suction surface thereof while the water in the porous layer of the band is being maintained at an underpressure so that the water present in the web is in hydraulic contact with the water in the porous layer of the Processing band through the liquid-saturated air impermeable fine porous suction, whereby the water contained in the web passes through the suction into the porous layer to dewater the web; and means for detaching the web from said processing band after dewatering.

11. The combination of claim 10 further including a long nip press through which a joint run of the web and said band passes, said long nip press comprising, two belt loops, each disposed on an opposite side of the joint run from the other, at least one roll means disposed within each respective belt loop for guiding the same, and two pressure shoe means, each disposed within a respective belt loop to apply pressure onto the joint run.

12. The combination of claim 10 further including a plurality of press nips through which said processing band passes for compressing said band to remove some water from the porous layer thereof whereupon the band expands to be made absorptive.

13. The combination of claim 10 further including means for washing said processing band after separation of the web therefrom.

14. The combination of claim 10 further including at least one of an infra-red heater and a mechanical high frequency vibrator disposed along a joint run of said band and web to enhance removal of therefrom.

* * * * *